US008092186B2

(12) United States Patent
Jang et al.

(10) Patent No.: US 8,092,186 B2
(45) Date of Patent: Jan. 10, 2012

(54) RANDOM PITCH IMPELLER FOR FUEL PUMP

(75) Inventors: Jin-Wook Jang, Seoul (KR); Yong-Taek Hwang, Pyeongtaek-Si (KR); Young-seok Choi, Gwangmyeong-si (KR); Kyoung-Yong Lee, Cheonan-si (KR); Uk-Hee Jeong, Seoul (KR); Murase Seiji, Chita-gun (JP)

(73) Assignee: Hyundam Industrial Co., Ltd. (KR)

( * ) Notice: Subject to any disclaimer, the term of this patent is extended or adjusted under 35 U.S.C. 154(b) by 463 days.

(21) Appl. No.: 12/430,235

(22) Filed: Apr. 27, 2009

(65) Prior Publication Data

US 2010/0054949 A1 Mar. 4, 2010

(30) Foreign Application Priority Data

Aug. 29, 2008 (KR) ..... 10-2008-0084840

(51) Int. Cl.
*F04D 29/18* (2006.01)

(52) U.S. Cl. ..... 416/223 R; 416/203; 416/241 R; 415/55.1

(58) Field of Classification Search ..... 416/203, 416/223 R, 241 R; 415/55.1
See application file for complete search history.

(56) References Cited

U.S. PATENT DOCUMENTS 5,158,434 A * 10/1992 Weetman ..... 416/201 A
6,139,275 A * 10/2000 Noda et al. ..... 416/203
6,554,574 B1 * 4/2003 Spaggiari ..... 416/203
2001/0036400 A1 * 11/2001 Kobayashi et al. ..... 415/55.1

FOREIGN PATENT DOCUMENTS

JP 11-050990 2/1999
KR 101 999 002 3306 3/1999

* cited by examiner

*Primary Examiner* — Angel Roman

(74) *Attorney, Agent, or Firm* — Daniel A. Thomson; Emerson Thomson Bennett, LLC

(57) ABSTRACT

A random pitch impeller for a fuel pump has number of blades. An incremental angle of the blades is set by the expression:

$$\Delta\theta i = \left(\frac{360}{N}\right) + (-1)^i \times Am \times \sin\left(p_1 \times \frac{360}{N} \times i\right) \times \cos\left(P_2 \times \frac{360}{N} \times i\right),$$

where ΔθI is the incremental angle between the blades, N is the total number of blades (N=2, 3, 5, 7, 11, 13, 17, . . . ), Am is the distribution magnitude of the inter-blade interval (equally divided angle) (0<Am<360/N), i is the order of the blade (i=1, 2, 3, . . . , N), and $P_1$ and $P_2$ are the factors exerting an influence on the cycle ($0<P_1<N$, and $0 \leqq P_2 \leqq N$). The incremental angle has maximum and minimum values a difference of which satisfies the expression: $2° \leqq MAX-MIN \leqq 6°$, where MAX is the maximum value, and MIN is the minimum value of the incremental angle.

7 Claims, 5 Drawing Sheets

RANDOM PITCH IMPELLER FOR FUEL PUMP

CLAIM OF PRIORITY

This application claims the benefit of Korean Patent Application No. 2008-0084840 filed on Aug. 29, 2008, in the Korean Intellectual Property Office, the disclosure of which is incorporated herein by reference.

BACKGROUND OF THE INVENTION

1. Field of the Invention

The present invention relates to a random pitch impeller for a fuel pump, and more particularly, to a random pitch impeller for a fuel pump, in which blades of the impeller used for the fuel pump are arranged at random pitches, thereby reducing high-frequency noise generated by rotation of the impeller, and minimizing pulsation noise attributable to random intervals.

2. Description of the Related Art

There have been known various apparatuses for drawing and/or discharging fluid, one of which is a fuel pump. This fuel pump is used in the fuel supply system of the internal combustion engine and draws or discharges fluid, particularly fuel, by means of rotation of a rotating member such as an impeller formed on a disc and having blades on the outer circumference thereof.

As illustrated in FIG. 1, the fuel pump includes a pump housing 102 having upper and lower housing parts, a disc-shaped impeller 101 rotatably installed in the pump housing 102, and a drive motor 103 rotating the impeller 101.

Generally, the impeller of this fuel pump has numerous blades installed on the outer circumference thereof at uniform pitches, i.e. at equal intervals. Thus, when the rotating member rotates, each blade of the impeller passes through a partition, which is installed on the housing holding the rotating member, at constant time intervals. At this time, the partition is located adjacent to the blade between inlet and outlet of the fuel. For this reason, a peak of sound pressure (i.e. noise) is created within a certain frequency band, i.e. a so-called blade passing frequency (BPF) band, corresponding to the number of blades (or the revolutions per minute (rpm) of the rotating member).

In order to solve this problem, Japanese Patent Publication No. Hei 11(1999)-50990 discloses a fluid drawing and discharging apparatus, in which the intervals between the blades are disposed in a random manner, namely in an irregular manner. The fluid drawing and discharging apparatus disclosed in the patent document encounters a phenomenon that the blades lean to one side as illustrated in FIG. 2 because the blades are randomly disposed.

Further, as illustrated in FIG. 3, since the time intervals at which each blade passes through the partition adjacent to the blade are constant without a difference, the sound pressure peak, a frequency of which is n times as high as a rotation-order frequency of the rotating member, occurs, or noise is increased within the frequency band of the sound pressure peak by resonance according to circumstances.

In order to overcome this drawback, Korean Patent Application Publication No. 1999-23306 discloses a fluid drawing and discharging apparatus, in which the sum "Sm" of angles of blades satisfies the expression, $(360/k)-10 \leqq Sm \leqq (360/k)+10 (k=2, 3, 4)$, such that the average of incremental angles in a specific section is similar to a grand average, thereby reducing noise.

However, these fluid drawing and discharging apparatuses control the blade arrangement on the basis of a random number, so that prediction and control of the blade arrangement are impossible.

SUMMARY OF THE INVENTION

The present invention has been made to solve the foregoing problems with the prior art, and therefore the present invention provides a random pitch impeller for a fuel pump, in which blades thereof are arranged at random pitches without being deflected in a specific section so as to reduce a sound pressure peak, and in which the random pitches of the blades are set on the basis of a periodic function so as to easily predict and adjust the arrangement of the blades.

There is provided a random pitch impeller for a fuel pump, capable of reducing noise through distribution of high-frequency peaks of the impeller, and minimizing pulsation noise (low-frequency peak) attributable to random intervals.

According to an aspect of the invention, there is provided an impeller for a fuel pump, having a number of blades, wherein: the blades have an incremental angle set by an expression below:

$$\Delta\theta i = \left(\frac{360}{N}\right) + (-1)^i \times Am \times \sin\left(p_1 \times \frac{360}{N} \times i\right) \times \cos\left(P_2 \times \frac{360}{N} \times i\right),$$

where $\Delta\theta I$ is the incremental angle between the blades, N is the total number of blades (N=2, 3, 5, 7, 11, 13, 17, . . . ), Am is the distribution magnitude of the inter-blade interval (equally divided angle) ($0<Am<360/N$), i is the order of the blade (i=1, 2, 3, . . . , N), and $P_1$ and $P_2$ are the factors exerting an influence on the cycle ($0<P_1<N$, and $0 \leqq P_2 \leqq N$); and the incremental angle has maximum and minimum values a difference of which satisfies an expression:

$$2° \leqq MAX-MIN \leqq 6°,$$

where MAX is the maximum value, and MIN is the minimum value of the incremental angle.

According to embodiments of the present invention, the impeller for a fuel pump arranges the blades at random pitches using a rand pitch function, prevents deflection of the blades by means of the term $(-1)^i$ of the random pitch function to thereby reduce a sound pressure peak, and creates the random pitches of the blades on the basis of a periodic function using both the distribution magnitude Am of the inter-blade interval (equally divided angle) and the factors $P_1$ and $P_2$ exerting an influence on a cycle so as to easily predict or adjust the arrangement of the blades.

Further, the impeller minimizes a low-frequency peak, pulsation noise, caused by the random intervals thereof and the resultant random flow.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION

The present invention will now be described more fully hereinafter with reference to the accompanying drawings, in which exemplary embodiments thereof are shown.

According to an embodiment of the present invention, an impeller for a fuel pump sets an incremental angle, $\Delta\theta i$, between blades as in Expression 1 (called a random pitch function) below:

$$\Delta\theta i = \left(\frac{360}{N}\right) + (-1)^i \times Am \times \sin\left(p_1 \times \frac{360}{N} \times i\right) \times \cos\left(P_2 \times \frac{360}{N} \times i\right), \quad \text{Expression 1}$$

where N is the total number of blades and the prime number (N=2, 3, 5, 7, 11, 13, 17, . . . ), Am is the distribution magnitude of the inter-blade interval (equally divided angle) ($0<Am<360/N$), i is the order of the blade (i=1, 2, 3, . . . , N), and $P_1$ and $P_2$ are the factors exerting much influence on the cycle ($0<P_1<N$, and $0 \leqq P_2 \leqq N$).

With this random pitch function, the impeller not only makes random pitch conditions of the same structure despite a change in the number of blades, but also makes the average of the incremental angles within a specific section similar to a grand average because the created functions comply with an oscillation (divergence) function due to the term $(-1)^i$.

Figure 1:
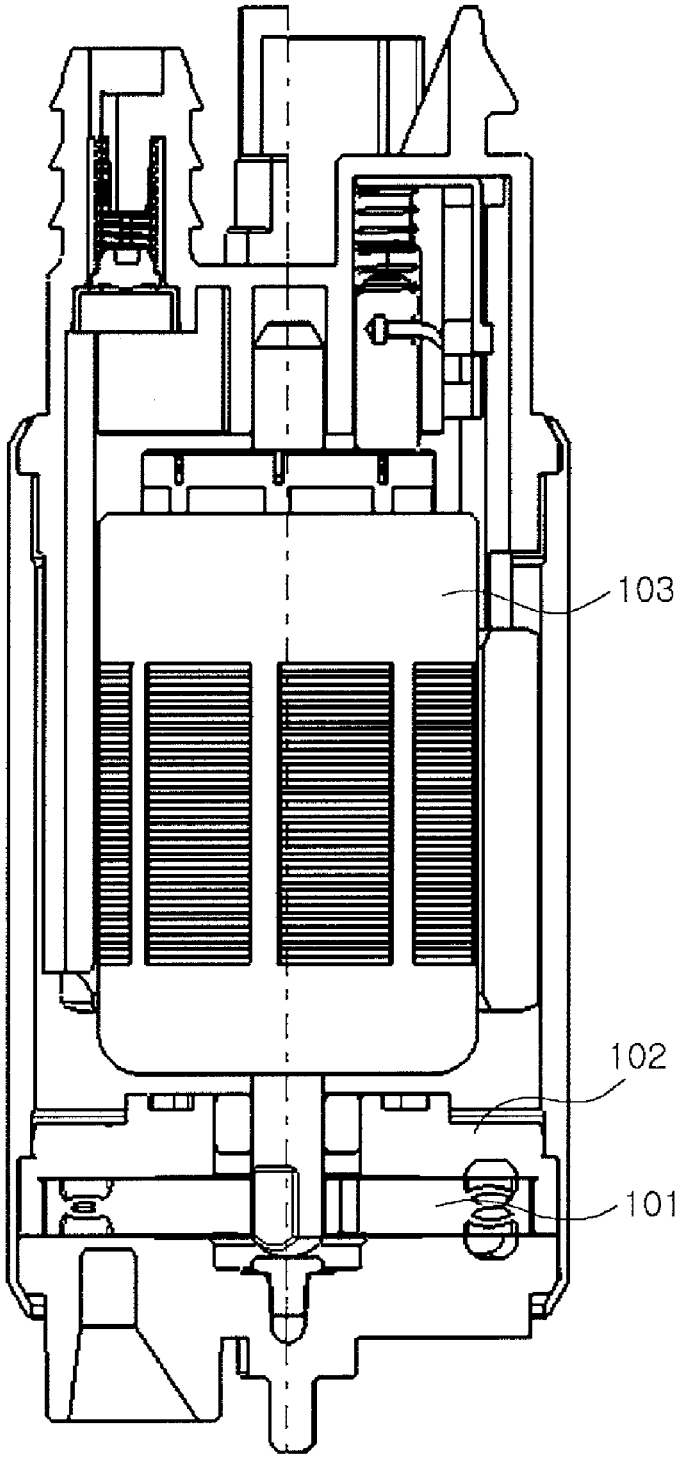
FIG. 1 illustrates the structure of a fuel pump.
Figure 2:
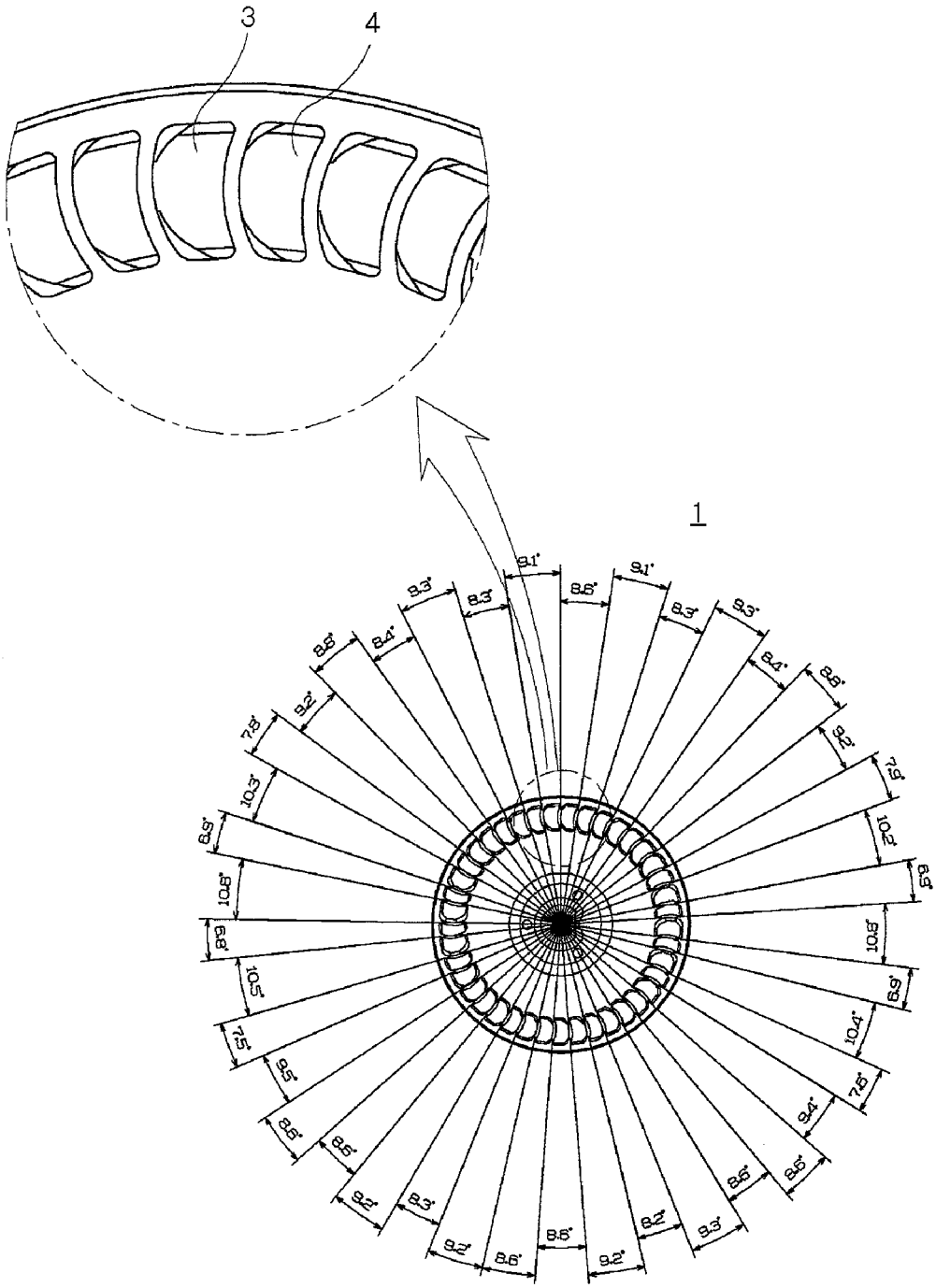
FIG. 2 illustrates arrangement of blades of a random pitch impeller according to an embodiment of the present invention.

FIG. 2 illustrates an impeller for a fuel pump which is designed by random pitch arrangement in accordance with an embodiment of the present invention. It can be seen that the neighboring blades 3 and 4 are arranged at intervals of a random angle rather than of a uniform angle.

MAX Minus MIN VALUE

According to an embodiment of the present invention, the impeller for a fuel pump can arrange the blades at random pitches by setting the incremental angle depending on Expression 1 above. However, in comparison of a uniform pitch impeller having the same angles between the blades with the random pitch impeller of this embodiment, the number of high-frequency peaks is obtained to an equivalent level in a specific section. Here, the specific section refers to a section where a difference between the maximum and minimum values "MAX" and "MIN" of the incremental angle is less than 2.

Figure 3:
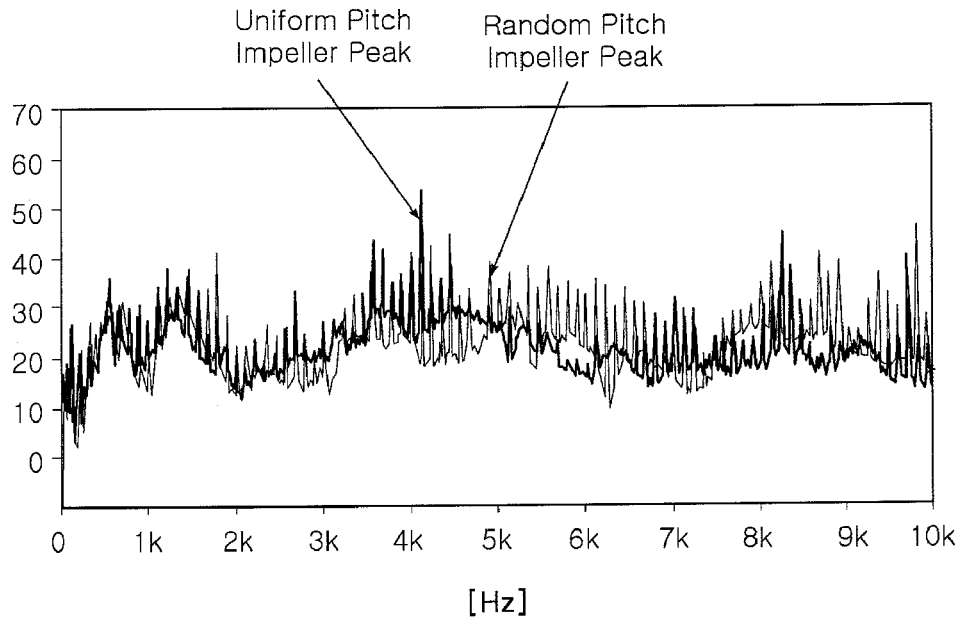
FIG. 3 is a graph showing results of comparing high-frequency peaks of a uniform pitch impeller with that of a random pitch impeller according to an embodiment of the present invention.

Thus, the difference between the maximum and minimum values of the incremental angle is preferably more than 2. Two kinds of noise measured from the uniform pitch impeller and the random pitch impeller under this condition are shown on a graph of FIG. 3. On this graph, the maximum value of the high-frequency peak of the uniform pitch impeller is about 53 dB(A), while the maximum value of the high-frequency peak of the random pitch impeller of this embodiment is about 45 dB(A). It can be seen from this result that the high-frequency peaks of the random pitch impeller are distributed to reduce entire noise.

Further, when the blades of the impeller are arranged at random pitches, it must be taken into consideration that an angle of minimizing low-frequency pulsation noise is selected. When transferring fluid, the uniform pitch impeller having the same inter-blade interval generates a small quantity of pulsation noise due to the same fluid passing area between the blades. In contrast, the random pitch impeller having a different inter-blade interval generates a large quantity of pulsation noise because it is impossible to form a constant flow. When the pulsation noise is increased, the low-frequency peak is increased. Particularly, the pulsation noise becomes more troublesome in proportion to a discharged flow rate of the impeller.

Figure 4:
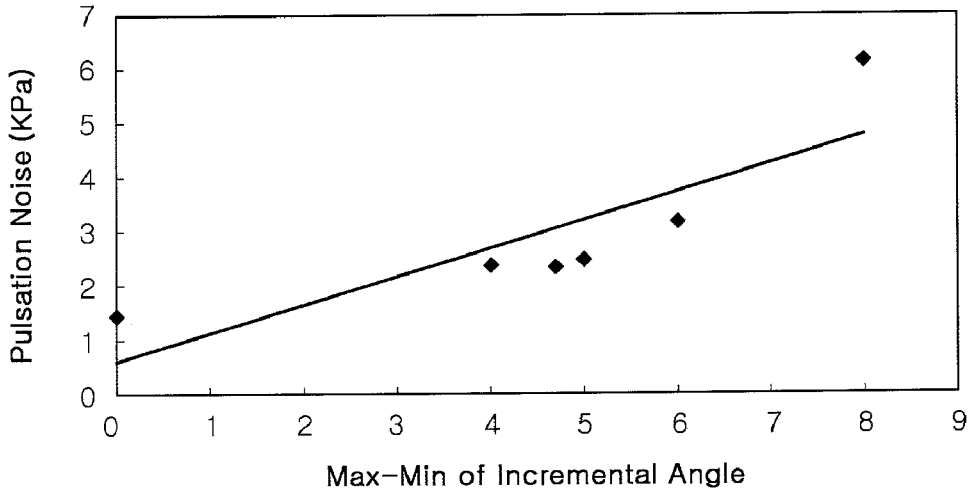
FIG. 4 is a graph showing a variation in pulsation noise.

Thus, in the random pitch impeller of this embodiment, when the difference between the maximum and minimum values "MAX" and "MIN" of the incremental angle is less than 6, a value of this pulsation noise can be limited to a certain level (about 3 Kpa or less). FIG. 4 is a graph showing results of analyzing a variation of pulsation noise caused by a difference between the maximum and minimum values of the incremental angle. Here, points are to designate the pulsation noise values shown in Table 1 below. It can be seen from FIG. 4 that, when the difference between the maximum and minimum values of the incremental angle is less than 6, the pulsation noise value can be controlled less than a predetermined level.

TABLE 1

| | MAX Minus MIN Value | | | | | |
|---|---|---|---|---|---|---|
| | 0 | 4 | 5 | 4.7 | 6.1 | 8 |
| Pulsation Noise Value (Kpa) | 1.43 | 2.37 | 2.46 | 2.33 | 3.17 | 6.14 |

In order to satisfy all the conditions considered above, the random pitch impeller of this embodiment preferably restricts the difference between the maximum and minimum values of the incremental angle as in Expression 2 below:

$$2° \leqq MAX-MIN \leqq 6° \quad \text{Expression 2,}$$

where MAX is the maximum value of the incremental value, and MIN is the minimum value of the incremental value.

The embodiment presents that both the high-frequency peak and the low-frequency peak can be properly controlled through the difference between the maximum and minimum values of the incremental angle.

Average of Incremental Angles in Specific Section

According to an embodiment of the present invention, the random pitch impeller controls the average of incremental angles in a specific section so as to have a value similar to the average of total blade angles such that the blades of the impeller can be arranged at unequal intervals to distribute high-frequency peaks, and simultaneously pulsation noise generated by the unequal intervals can be minimized. Thus, the average of the incremental angles in the specific section and the average of the total blade angles (i.e. 360/N) are controlled so as to satisfy Expression 3 below:

$$(AVG_TOT-0.5) \leqq AVG_SEC \leqq (AVG_TOT+0.5) \quad \text{Expression 3,}$$

where "AVG_SEC" is the average of the incremental angles in the specific section, and "AVG_TOT" is the average of the total blade angles.

For example, it is assumed that the total number of blades is 41 (i.e. N=41). Here, when the specific section is set to ¼ of the total number of blades, the number of blades of the specific section becomes 41/4 (=10.25). In detail, when the average "AVG_SEC" of ten neighboring incremental angles is derived, the derived average must be similar to the average "AVG_TOT" of the total blade angles, i.e. 360/N. Here, the average of the total blade angles becomes 360/41 (=8.8).

Figure 5:
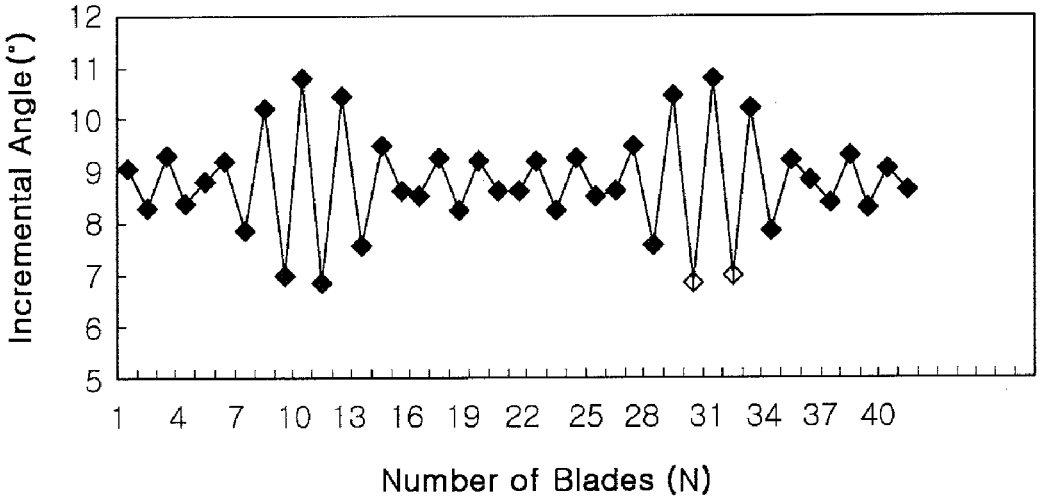
FIG. 5 is a graph showing incremental angles of blades of a random pitch impeller according to an embodiment of the present invention.

FIG. 5 is a graph showing incremental angles of blades arranged at random pitches when the total number of blades is 41 in accordance with an embodiment of the present invention. It can be seen that the average of the incremental angles is about 8.8. At this time, the average "AVG_SEC" of the neighboring incremental angles in a section corresponding to ¼ of the whole blades is preferably set to a range of ±0.5 on the basis of the average of the total incremental angles.

Figure 6:
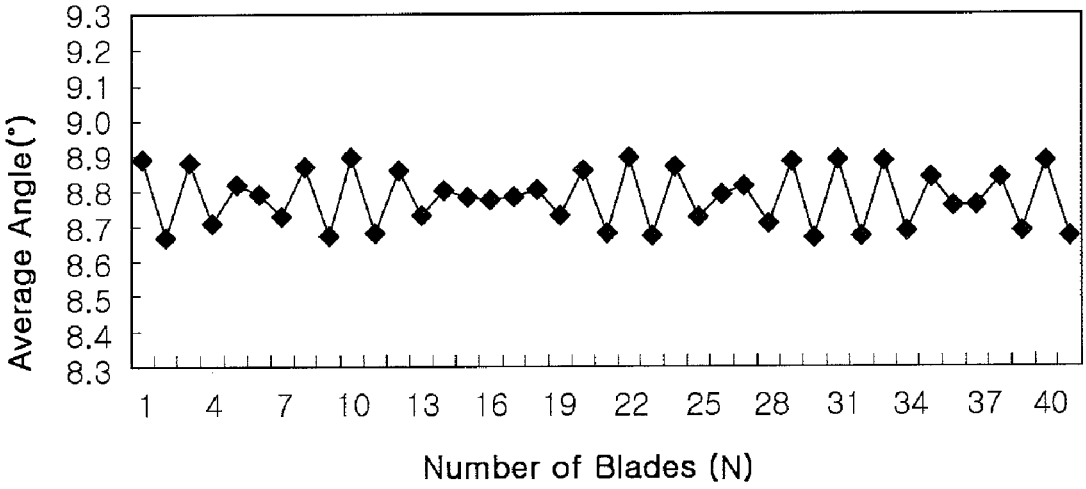
FIG. 6 is a graph showing an average of incremental angles of neighboring blades in a quarter section.

FIG. 6 is a graph showing an average of incremental angles of neighboring blades in a quarter section when the total number of blades is 41. For example, when an x-axial value is 17, this value is an average of incremental angles of $8^{th}$ through $17^{th}$ blades. When an axial value is 1, this value is an average of incremental angle of $33^{rd}$ through $4^{st}$ and $1^{st}$ blades. As shown in FIG. 6, the average of the incremental angles of the blades in each quarter section is set to an allowance range of ±0.5 on the basis of the average of the total incremental angles.

Selection of Number of Blades

Figure 7:
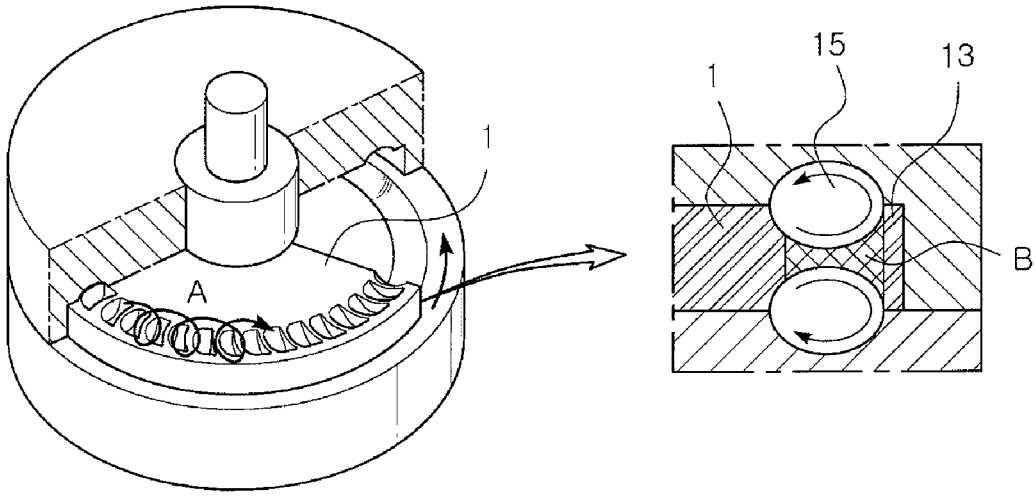
FIG. 7 illustrates how a rotating flow is created from an impeller.

In order to secure a value exercising an influence on performance such as a flow rate, electric current, rpm, etc. under the use conditions of the fuel pump, the number of blades preferably has a range from 31 to 47, i.e. 31≦N≦47. If the number of blades preferably is equal to or less than 31, the interval between the neighboring blades of the impeller is increased. At this time, in the case of a low-capacity impeller having a relatively low rpm, the performance of the fuel pump is considerably reduced. In detail, if the speed of a rotating flow is increased in a channel, the capacity of raising pressure is improved as much, and thus the performance of the fuel pump is improved. In contrast, if the interval between the neighboring blades of the impeller is increased, the speed of the rotating flow is reduced, and thus the performance of the fuel pump is reduced. FIG. 7 shows a process in which a rotating flow 15 is created as an outer circumferential wall 13 of an impeller 1 rotates. Here, the symbol A designates a direction where fuel flows, and the symbol B represents a shape where the fuel passes.

Further, if the number of blades exceeds 47, the interval between the neighboring blades of the impeller is reduced, and thus an area through which fluid can pass is reduced. As such, when transferring a high flow rate, the impeller is subjected to an increase in load, an increase in electric current, and a decrease in flow rate performance, so that the performance of the fuel pump is greatly reduced. Thus, the number of blades of the impeller is preferably set under the use conditions of the fuel pump as in Expression 4 below:

$$31 \leqq N \leqq 47 \qquad \text{Expression 4,}$$

where N is the total number of blades.

Conditions of Other Factors

In order to satisfy all the conditions of Expressions 1 through 4 as described above, the value of Am of Expression 1 is preferably set as follows: 1≦Am≦3. In Expression 1, $P_1$=1 or $P_1$=N−1. Further, $P_2$=2*$P_1$.

In order to satisfy the conditions presented to Expressions 1 through 4 above, both the distribution magnitude Am of the inter-blade interval (i.e., equally divided angle) and the factors $P_1$ and $P_2$ exerting much influence on the cycle are controlled. Thereby, the pitch conditions that are similar to the random pitch conditions and have predetermined intervals can be created, so that the arrangement of the blades can be easily predicted or adjusted.

Setting of Final Incremental Angle

When the incremental angles between the blades are set on the basis of Expression 1, a sum of all the incremental angles may be more or less than 360°. In this case, the final incremental angle must be separately defined on the assumption that it should satisfy Expressions 2 and 3. In other words, in the case in which the sum of all the incremental angles is not equal to 360°, the final incremental angle is obtained by Expression 5:

$$\Delta\theta n = 360 - \sum_{n-1}^{1} \Delta\theta i, \qquad \text{Expression 5}$$

where the final incremental angle must also meet the conditions of Expressions 2 and 3.

Further, the incremental angles created through Expression 1 are preferably rounded only to the first decimal place. If the incremental angles are applied without limiting the decimal point, some numbers after the first decimal place are reflected on the angle between the neighboring blades and the angle of installation, a difference of the total sum occurs. As in the embodiment, in the case in which the total number of blades is 41 (N=41), the sum of the total incremental angles satisfies 360° when the incremental angles are limited to the first decimal place.

While the present invention has been described with reference to the particular illustrative embodiments and the accompanying drawings, it is not to be limited thereto. Accordingly, the foregoing embodiments can be suitably modified and altered, and such applications fall within the scope and spirit of the present invention that shall be defined by the appended claims.

What is claimed is:

1. An impeller for a fuel pump comprising:

at least two blades, wherein the blades have an incremental angle set by an expression below:

$$\Delta\theta i = \left(\frac{360}{N}\right) + (-1)^i \times Am \times \sin\left(p_1 \times \frac{360}{N} \times i\right) \times \cos\left(P_2 \times \frac{360}{N} \times i\right),$$

where ΔθI is the incremental angle between the blades, N is the total number of blades (N=2, 3, 5, 7, 11, 13, 17, . . . ), Am is the distribution magnitude of the inter-blade interval (equally divided angle) (0<Am<360/N), i is the order of the blade (i=1, 2, 3, . . . , N), and $P_1$ and $P_2$ are the factors exerting an influence on the cycle (0<$P_1$<N, and 0≦$P_2$≦N); and the incremental angle has maximum and minimum values a difference of which satisfies an expression:

$$2° \leqq MAX - MIN \leqq 6°,$$

where MAX is the maximum value, and MIN is the minimum value of the incremental angle.

2. The impeller as set forth in claim 1, wherein the blades have a total number satisfying an expression: 31≦N≦47, where N is the total number.

3. The impeller as set forth in claim 1, wherein the incremental angle and the total blade angles satisfy an expression:

$$(AVG_TOT - 0.5) \leqq AVG_SEC \leqq (AVG_TOT + 0.5),$$

where AVG_SEC is an average of the incremental angles in a specific section, 360/N is total blade angles, and AVG_TOT is an average of the total blade angles.

4. The impeller as set forth in claim 3, wherein the specific section is a section corresponding to a quarter of the total blades.

5. The impeller as set forth in claim 1, wherein the distribution magnitude, Am, satisfies an expression of $1 \leqq Am \leqq 3$.

6. The impeller as set forth in claim 1, wherein the factor, $P_1$, satisfies one of expressions of $P_1=1$ and $P_1=N-1$, and the factor, $P_2$, satisfies an expression of $P_2=2*P_1$.

7. The impeller as set forth in claim 1, wherein, when a sum of all the incremental angles is not equal to 360°, the incremental angles satisfy an expression:

$$\Delta\theta n = 360 - \sum_{n-1}^{1} \Delta\theta i,$$

where Δηn is the final one of the incremental angles.

* * * * *